US007192161B1

(12) United States Patent
Cleaver et al.

(10) Patent No.: US 7,192,161 B1
(45) Date of Patent: Mar. 20, 2007

(54) FLUORESCENT ILLUMINATION DEVICE

(75) Inventors: Mark J. Cleaver, Wilmette, IL (US); George R. Hulse, Cookeville, TN (US)

(73) Assignee: iLight Technologies, Inc., Chicago, IL (US)

( * ) Notice: Subject to any disclaimer, the term of this patent is extended or adjusted under 35 U.S.C. 154(b) by 96 days.

(21) Appl. No.: 10/872,861

(22) Filed: Jun. 21, 2004

Related U.S. Application Data

(63) Continuation-in-part of application No. 10/455,639, filed on Jun. 5, 2003, which is a continuation-in-part of application No. 09/982,705, filed on Oct. 18, 2001, now Pat. No. 6,592,238.

(51) Int. Cl.
*F21V 23/02* (2006.01)

(52) U.S. Cl. ..... 362/260; 362/293; 362/231; 362/224; 362/242

(58) Field of Classification Search ..... 362/231, 362/219, 222–225, 551, 555, 235, 240–248, 362/800, 260, 293, 583
See application file for complete search history.

(56) References Cited

U.S. PATENT DOCUMENTS

| | | | |
|---|---|---|---|
| 1,150,118 | A | 8/1915 | Hewitt |
| 1,275,871 | A | 8/1918 | Dodds et al. |
| 1,312,312 | A | 8/1919 | Dodds |
| 1,313,622 | A | 8/1919 | Dodds |
| 1,385,778 | A | 7/1921 | Dodds |
| 2,604,711 | A | 7/1952 | Porter |
| 3,780,462 | A | 12/1973 | Pregel et al. |
| 4,382,272 | A | 5/1983 | Quella et al. |

(Continued)

FOREIGN PATENT DOCUMENTS

| | | |
|---|---|---|
| CA | 2 282 819 | 3/2001 |

(Continued)

OTHER PUBLICATIONS

Neher, Dieter et al., Arbeitsgebiete und Methoden, Research fields, pp. 1-8, downloaded at http://www.uni-potsdam.de/u/physik/exphy/arbeit_eng.htm on Dec. 3, 2004.

(Continued)

*Primary Examiner*—Stephen F Husar
(74) *Attorney, Agent, or Firm*—Stites & Harbison, PLLC; David W. Nagle, Jr.; Jeffrey A. Haeberlin

(57) ABSTRACT

An illumination device for simulating neon or similar lighting uses fluorescent dyes, thus allowing for emission of light in colors that cannot ordinarily be achieved by use of LEDs alone. Such an illumination device is generally comprised of an elongated diffusing member enclosing a string of continuously mounted LEDs. An intermediate light-transmitting medium including a predetermined combination of one or more fluorescent dyes is interposed between the light source and the diffusing member, such that light from the LEDs is partially absorbed by each of the fluorescent dyes, and a lower-energy light is then emitted from each of the fluorescent dyes and into the light-receiving surface of the diffusing member, producing a substantially uniform light along the light-emitting surface of the diffusing member with perceived a color different than that of the LEDs.

25 Claims, 4 Drawing Sheets

U.S. PATENT DOCUMENTS

| | | | | |
|---|---|---|---|---|
| 4,607,317 | A | 8/1986 | Lin | |
| 4,912,605 | A | 3/1990 | Whitehead | |
| 5,607,222 | A | 3/1997 | Woog | |
| 5,654,552 | A | 8/1997 | Toombs | |
| 5,757,112 | A | 5/1998 | Sato | |
| 5,879,076 | A | 3/1999 | Cross | |
| 5,997,150 | A * | 12/1999 | Anderson | 362/227 |
| 6,183,102 | B1 | 2/2001 | Mortz et al. | |
| 6,276,634 | B1 | 8/2001 | Bodle | |
| 6,361,186 | B1 | 3/2002 | Slayden | |
| 6,471,388 | B1 * | 10/2002 | Marsh | 362/559 |
| 6,554,448 | B2 | 4/2003 | Carpenter et al. | |
| 6,653,765 | B1 * | 11/2003 | Levinson et al. | 313/112 |
| 6,676,284 | B1 | 1/2004 | Wilson | |
| 6,828,043 | B2 | 12/2004 | Sturley | |
| 2001/0043467 | A1 | 11/2001 | Carpenter et al. | |
| 2003/0085642 | A1 | 5/2003 | Pelka et al. | |
| 2003/0095401 | A1 | 5/2003 | Hanson et al. | |
| 2003/0189823 | A1 | 10/2003 | George et al. | |
| 2004/0154199 | A1 | 8/2004 | Robinson et al. | |
| 2004/0202893 | A1 | 10/2004 | Abe | |
| 2004/0244247 | A1 | 12/2004 | Bolta | |

FOREIGN PATENT DOCUMENTS

| | | |
|---|---|---|
| WO | 02/065016 | 8/2002 |

OTHER PUBLICATIONS ifire technology Press Release, Westaim's iFire Technology demonstrates high-luminance Color-by-Blue , May 20, 2003, downloaded at http://www.ifire.com/NewsCentre/PressReleaseDetails.aspx?id=56 on Aug. 5, 2003.

PCT International Search Report for international application No. PCT/US03/17765, Feb. 26, 2004.

European Patent Office, Supplementary European Search Report, Oct. 2, 2006, pp. 1-3, Munich, Germany.

* cited by examiner

FLUORESCENT ILLUMINATION DEVICE

CROSS-REFERENCE TO RELATED APPLICATIONS

The present application is a continuation-in-part of U.S. Utility application Ser. No. 10/455,639 filed Jun. 5, 2003, which itself is a continuation-in-part of U.S. Utility application Ser. No. 09/982,705 filed Oct. 18, 2001 (now U.S. Pat. No. 6,592,238), the entire disclosures of which are incorporated herein by reference.

BACKGROUND OF THE INVENTION

The present invention relates to an illumination device, an illumination device using high-intensity, low-voltage light sources and ideally adapted for lighting, signage and advertising uses.

Neon lighting, which is produced by the electrical stimulation of the electrons in a low-pressure neon gas-filled glass tube, has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications, including script writing and designs, because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well-established industry, a competitive lighting device must be lightweight and have superior "handleability" characteristics in order to make inroads into the neon lighting market. Neon lighting is recognized as being fragile in nature. Because of the fragility and heavy weight, primarily due to its supporting infrastructure, neon lighting is expensive to package and ship. Moreover, it is extremely awkward to initially handle, install, and/or replace. Any lighting device that can provide those previously enumerated positive characteristics of neon lighting, while minimizing its size, weight, and handleability shortcomings, will provide for a significant advance in the lighting technology.

The recent introduction of lightweight and breakage resistant point light sources, as exemplified by high-intensity light-emitting diodes (LEDs), have shown great promise to those interested in illumination devices that may simulate neon lighting and have stimulated much effort in that direction. However, the twin attributes of neon lighting, uniformity and brightness, have proven to be difficult obstacles to overcome as such attempts to simulate neon lighting have largely been stymied by the tradeoffs between light distribution to promote the uniformity and brightness.

In an attempt to address some of the shortcomings of neon, commonly assigned U.S. Pat. No. 6,592,238, which has been incorporated herein by reference, describes an illumination device comprising a profiled rod of material having waveguide properties that preferentially scatters light entering one surface ("light-receiving surface") so that the resulting light intensity pattern emitted by another surface of the rod ("light-emitting surface") is elongated along the length of the rod. A light source extends along and is positioned adjacent the light-receiving surface and spaced from the light-emitting surface a distance sufficient to create an elongated light intensity pattern with a major axis along the length of the rod and a minor axis that has a width that covers substantially the entire circumferential width of the light-emitting surface. In a preferred arrangement, the light source is a string of point light sources spaced a distance apart sufficient to permit the mapping of the light emitted by each point light source into the rod so as to create elongated and overlapping light intensity patterns along the light-emitting surface and circumferentially about the surface so that the collective light intensity pattern is perceived as being uniform over the entire light-emitting surface.

There have also been various other attempts in the prior art to replicate neon lighting through the use of "tube" lights. For example, U.S. Pat. No. 6,361,186 issued to Slayden describes and claims a simulated neon light in which a series of LEDs are housed within an elongated translucent diffuser.

In any event, a problem with illumination devices using LEDs is that the available visible color spectrum is limited by the finite availability of LED colors. There is thus a need for an illumination device that allows for emission of light in colors that cannot ordinarily be achieved by use of LEDs alone without significant increase in cost or complexity of the illumination device.

SUMMARY OF THE PRESENT INVENTION

The present invention is an illumination device for simulating neon or similar lighting through use of fluorescent dyes, thus allowing for emission of light in colors that cannot ordinarily be achieved by use of LEDs alone without significant increase in cost or complexity of the illumination device. Such an illumination device is generally comprised of a diffusing member and a light source. In one exemplary embodiment, the diffusing member has a substantially hollow tube construction, with an external surface serving as a light-emitting surface and an interior surface that serves as a light-receiving surface, such that light entering the diffusing member from the light source is scattered within the diffusing member so as to exit with diffused distribution.

Although it is contemplated that various types of light sources could be incorporated into the illumination device of the present invention, a string or strings of contiguously mounted high-intensity light-emitting diodes (LEDs) is a preferred light source. However, since the available visible color spectrum of an illumination device incorporating LEDs as the light source is limited by the finite availability of LED colors, the illumination device of the present invention is constructed so as to provide for emission of light with a perceived color that is different than that of the LED itself. Specifically, this is accomplished through the incorporation of a light color conversion system into the illumination device. This intermediate light-transmitting medium is preferably composed of a substantially translucent acrylic or similar material tinted with a predetermined combination of one or more fluorescent dyes. Because of the position of the intermediate light-transmitting medium between the light source and the diffusing member, light emitted from the light source is directed into the intermediate light-transmitting medium and interacts with the fluorescent dyes contained therein. This light is partially absorbed by each of the fluorescent dyes of the intermediate light-transmitting medium, and a lower-energy light is then emitted from each of the fluorescent dyes and into the light-receiving surface of the diffusing member. Thus, through selection of appropriate combinations of dyes and varying the density of the dyes within the intermediate light-transmitting medium, applicants have been able to produce various colors across the visible spectrum, colors that are ultimately observed along the light-emitting surface of the diffusing member.

As a further refinement, the light source of an illumination device made in accordance with the present invention may be substantially surrounded by a scattering member, which causes some initial scattering of the light emitted from the light source before it enters the intermediate light-transmitting medium.

As yet a further refinement, a second light-transmitting medium may be interposed between the light source and the scattering member such that some color changing occurs near the light source as light passes through this second light-transmitting medium, and the color is then further changed as light passes through the intermediate light-transmitting medium.

DETAILED DESCRIPTION OF THE PRESENT INVENTION

The present invention is an illumination device for simulating neon lighting through use of fluorescent dyes, thus allowing for emission of light in colors that cannot ordinarily be achieved by use of LEDs alone without significant increase in cost or complexity of the illumination device.

Figure 1:
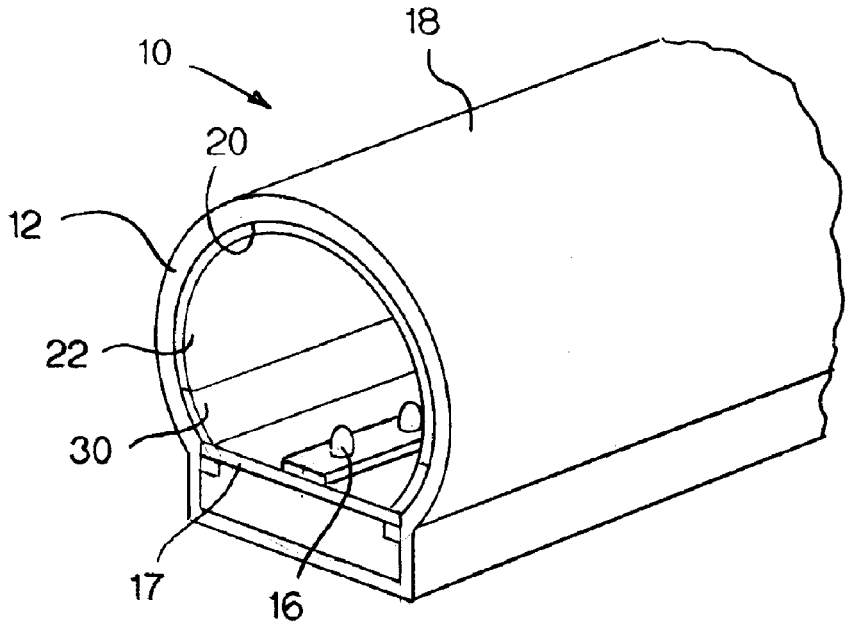
FIG. 1 is a perspective view of a portion of an exemplary illumination device made in accordance with the present invention.
Figure 2:
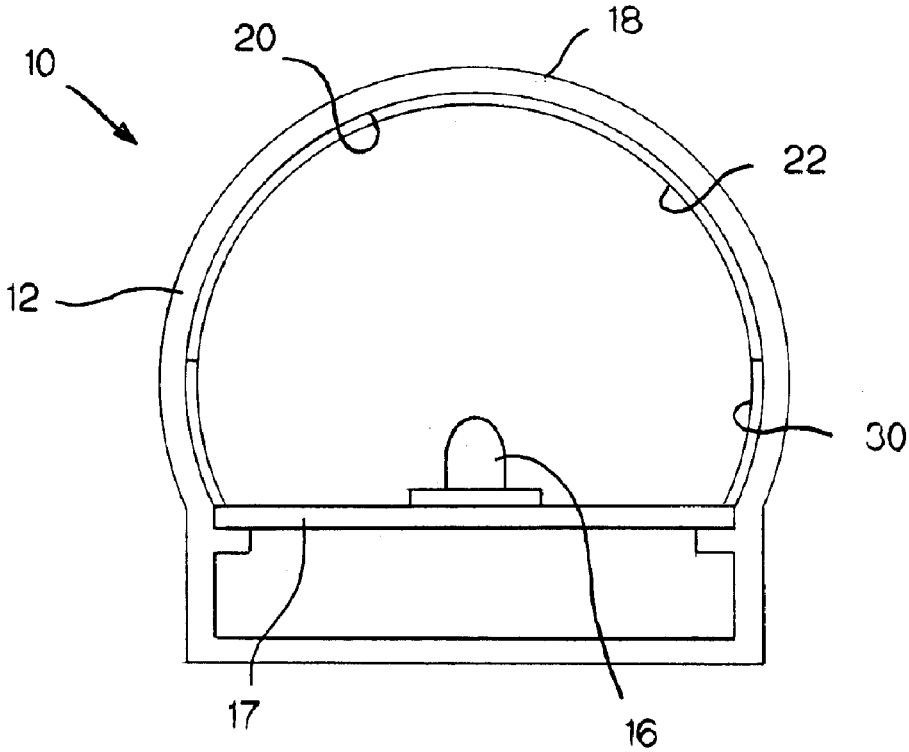
FIG. 2 is an end view of the illumination device of FIG. 1.

An exemplary illumination device 10 made in accordance with the present invention is illustrated in FIGS. 1–2. The illumination device 10 is generally comprised of an elongated diffusing member 12 and a light source 16. In this exemplary embodiment, the diffusing member 12 has a substantially hollow tube construction, with an external surface 18 serving as a light-emitting surface and an interior surface 20 that serves as a light-receiving surface. Light entering the diffusing member 12 from the light source 16 is scattered within the diffusing member 12 so as to exit with diffused distribution along the light-emitting surface 18.

As best shown in FIG. 2, the light source 16 and associated electrical accessories (including a circuit board 17) are preferably enclosed within the diffusing member 12. Although it is contemplated that various types of light sources could be incorporated into the illumination device of the present invention, applicants have determined that the best available light source for the purposes of this invention is a string or strings of contiguously mounted high-intensity light-emitting diodes (LEDs), as illustrated in FIGS. 1–2. However, as mentioned above, the available visible color spectrum of an illumination device 10 incorporating LEDs as the light source 16 is limited by the finite availability of LED colors. Furthermore, certain LED colors are significantly more expensive than others and/or have life spans that are significantly shorter than others. Thus, the illumination device 10 of the present invention is constructed so as to provide for emission of light with a perceived color that is different than that of the LEDs themselves.

This is accomplished through the incorporation of a light color conversion system into the illumination device 10, specifically an intermediate light-transmitting medium 22 extending along and positioned between the light source 16 and the diffusing member 12. This intermediate light-transmitting medium 22 is preferably composed of a matrix of a substantially translucent acrylic or similar material tinted with a predetermined combination of one or more fluorescent dyes.

In this particular embodiment, and as shown in FIGS. 1 and 2, the light-transmitting medium 22 is a layer of such tinted material applied to a portion of the interior circumferential wall of the diffusing member 12. This layer of tinted material could be in the form of a paint or similar material to facilitate its application to the interior circumferential wall of the diffusing member 12. Of course, the intermediate light-transmitting medium 22 could also be comprised of multiple layers of tinted material without departing from the spirit and scope of the present invention. Furthermore, the intermediate light-transmitting medium 22 could also be comprised of multiple side-by-side sections of tinted material arrayed around the interior circumferential wall of the diffusing member 12 to create a "striping" effect. Finally, the intermediate light-transmitting medium 22 could fill a portion of or substantially all of the interior of the substantially hollow diffusing member 12 without departing from the spirit and scope of the present invention.

Finally, in this particular embodiment and as a further refinement, the illumination includes a reflective surface or coating 30, which is applied to a lower portion of the interior circumferential wall of the diffusing member 12 on either side of and near the light source 16. This reflective surface or coating 30 serves to collect and direct light upwardly toward the upper portion of the diffusing member 12 to increase efficiency and the perceived intensity of the emitted light.

In order to better understand the construction and function of the illumination device 10 of the present invention, it is useful to discuss the concept of fluorescence. Fluorescence is the emission of certain electromagnetic radiation (i.e., light) from a body that results from the incidence of electromagnetic radiation on that body. In other words, if light energy is directed into a fluorescent body, that body absorbs some of the energy and then emits light of a lesser energy; for example, blue light that is directed onto a fluorescent body may emit a lower-energy green light.

Returning to the illumination device 10 of the present invention, the intermediate light-transmitting medium 22 and the fluorescent dyes contained therein serve as the fluorescent body. Specifically, because of its position between the light source 16 and the diffusing member 12, light emitted from the light source 16 is directed into the intermediate light-transmitting medium 22 and interacts with the fluorescent dyes contained therein. This light is partially absorbed by each of the fluorescent dyes of the intermediate light-transmitting medium 22, and a lower-energy light is then emitted from each of the fluorescent dyes and into the light-receiving surface 20 of the diffusing member 12. Thus, through selection of appropriate combinations of dyes and varying the density of the dyes within the intermediate light-transmitting medium 22, applicants have been able to produce various colors across the visible spectrum, colors that are ultimately observed along the light-emitting surface 18 of the diffusing member 12.

Figure 5B:
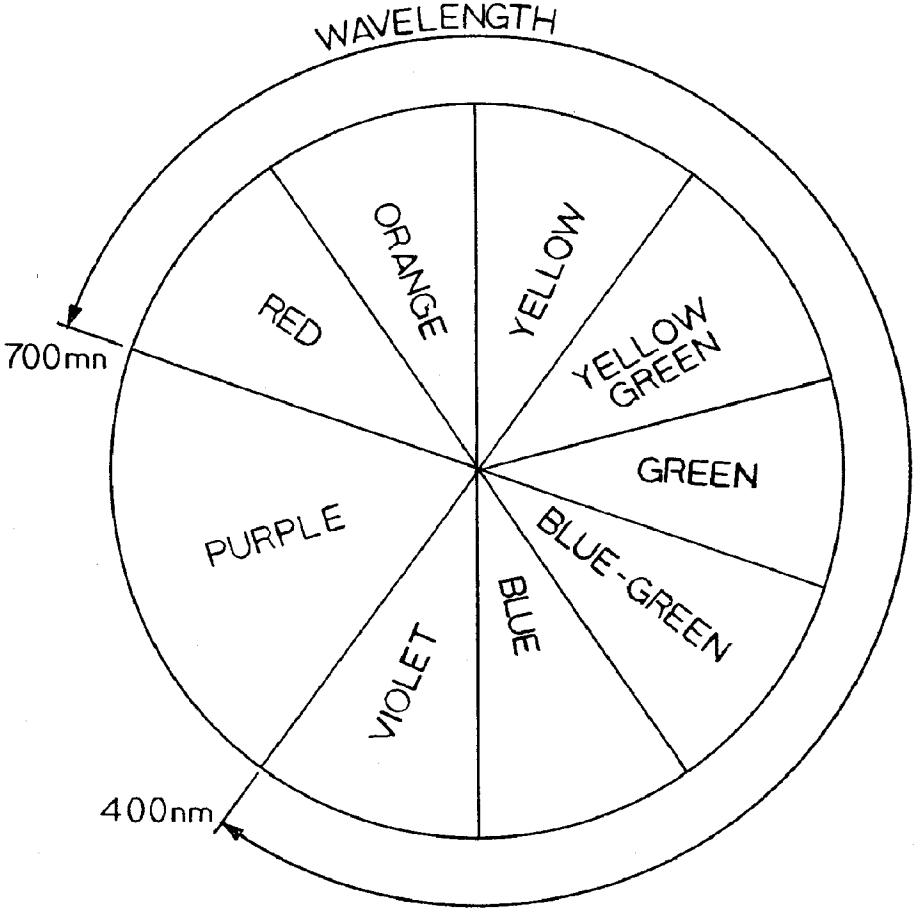
FIG. 5B illustrates the visible spectrum in a circular chart.
Figure 5A:
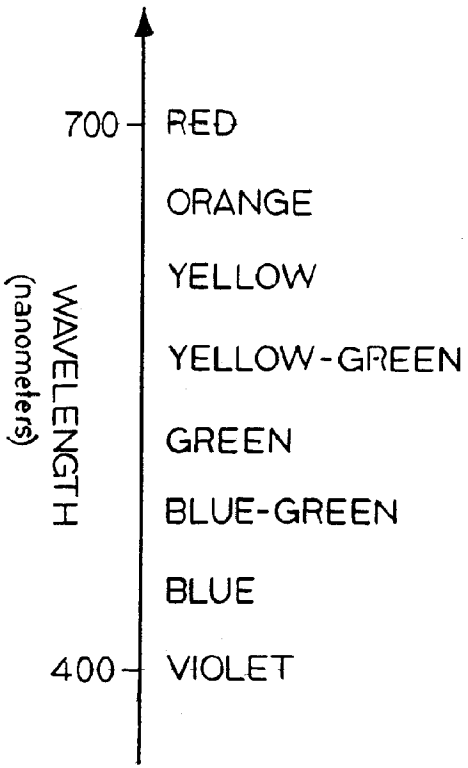
FIG. 5A illustrates the visible spectrum as a continuum of colors from violet (~400 nm) to red (~700 nm)

For example, blue LEDs are significantly less expensive than white LEDs, but last significantly longer than white LEDs. Furthermore, because blue light is a higher-energy light, applying the principles of fluorescence in accordance with the present invention, blue LEDs can be used to generate colors across the visible spectrum, from blue-green to red, as illustrated in FIGS. 5A and 5B. Therefore, blue LEDs are a preferred LED color for the illumination device 10 of the present invention.

Thus, in an illumination device 10 incorporating blue LEDs and constructed in accordance with the present invention, various combinations of fluorescent dyes can be incorporated into the intermediate light-transmitting medium 22 to achieve different colors. In this regard, preferred fluorescent dyes may be acquired from BASF Corporation of Mount Olive, N.J., including Lumogen® F240 (orange); Lumogen® F170 (yellow); and Lumogen® F285 (pink).

With respect to dye combinations, it is also important to recognize the nature of visible light and color. At the outset, visible light is light than can be perceived by the human eye. Visible light spans a range of wavelengths between approximately 400–700 nanometers (nm) (referred to as the "visible spectrum"), and the perceived color of light is based on its particular wavelength within this range. As illustrated in FIGS. 5A and 5B, the visible spectrum can be represented as a continuum or "rainbow" of colors from violet (~400 nm) to red (~700 nm), or alternatively, the visible spectrum can be represented in a circular chart. With respect to FIGS. 5A and 5B, it is important to recognize that many common colors are not represented in visible spectrum. For example, the color magenta is not represented by a single wavelength; rather, when the human eye perceives magenta, it is actually perceiving a combination of wavelengths in the red and violet ranges of the visible spectrum, and thus it is represented in the mixed region of the circular chart of FIG. 5B. Similarly, it is important to recognize that the color commonly referred to as white is not represented in FIG. 5A or 5B. When the human eye perceives white, it is actually perceiving a combination of wavelengths across the visible spectrum, the importance of which will be explained below.

Figure 6:
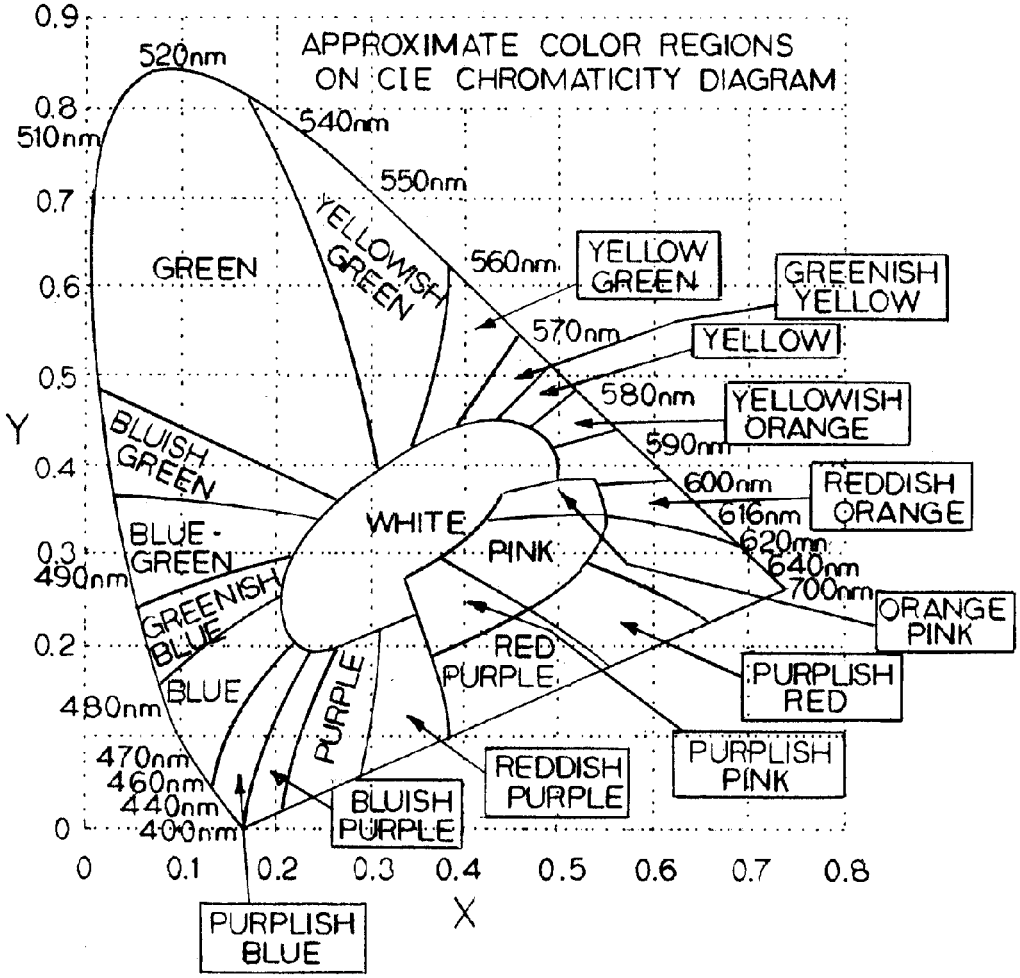
FIG. 6 is an illustration of the CIE Chromaticity Diagram.

Thus, most perceived "colors" are not representative of light of a single wavelength, but rather some combination of wavelengths. In this regard, the dominant color in light comprised of some combination of wavelengths is generally referred to as hue. In order to provide a mechanism to represent and identify all possible perceived colors, the Commission Internationale l'Eclairage (CIE) constructed the CIE Chromaticity Diagram, which is based on three ideal primary light colors of red, blue, and green. The CIE Chromaticity Diagram is a well-known tool for identifying colors and is well understood by one of ordinary skill in the art. Specifically, as illustrated in FIG. 6, the x-axis of this chart represents the amount of ideal red that would be mixed with ideal blue, and the y-axis of this chart represents the amount of ideal green that would be mixed with ideal blue. Thus, using the CIE Chromaticity Diagram, a desired color can be identified in terms of its x and y coordinates. It is also important to recognize that the chromaticity curve, which is representative of the visible spectrum, is commonly superimposed over the chart such that wavelengths within the visible spectrum are represented along this curve.

The CIE Chromaticity Diagram is also helpful in understanding mixtures of primary light colors. Specifically, if a straight line is drawn between two points on the chromaticity curve, for example from green with a wavelength of 510 nm to red with a wavelength of 700 nm, that straight line illustrates the range of colors that could be created and perceived by the human eye, depending on the relative amounts of primary light colors in the mixture, including various yellowish-green colors and oranges.

It is also important to recognize that the central region of the CIE Chromaticity Diagram is representative of white, a combination of the three ideal primary light colors. If any straight line between two colors on the chromaticity curve passes through this central region, those two colors can be mixed to create a perceived white color.

Again, returning to the exemplary embodiment illustrated in FIGS. 1 and 2, through selection of appropriate combinations of dyes and varying the density of the dyes within the intermediate light-transmitting medium 22, various colors can be produced across the visible spectrum, colors that are observed along the light-emitting surface 18 of the diffusing member 12.

As mentioned above, light emitted from the fluorescent dyes contained in the intermediate light-transmitting medium 22 is transmitted through the intermediate light-transmitting medium 22 to the light-receiving surface 20 of the diffusing member 12. What is visually perceived is a substantially uniform and elongated light pattern being emitted along the light-emitting surface 18 of the diffusing member 12, thus making the illumination device 10 an effective simulator of neon lighting.

As described in commonly assigned U.S. Pat. No. 6,592,238, applicants have found that acrylic material appropriately treated to scatter light to be one preferred material for the diffusing member 12. Moreover, such acrylic material is easily molded or extruded into rods having the desired shape for a particular illumination application, is extremely light in weight, and withstands rough shipping and handling. While acrylic material having the desired characteristics is commonly available, it can be obtained, for example, from AtoHaas of Philadelphia, Pa. under order number DR66080 with added frosted characteristics. Alternatively, other materials, such as such as bead-blasted acrylic or polycarbonate, or painted acrylic or polycarbonate, may also be used for the diffusing member 12 without departing from the spirit and scope of the present invention.

With respect to the scattering of light so as to cause it to appear uniform along the length of the diffusing member 12, it is noteworthy that the dyes of the intermediate light-transmitting medium 22 also tend to cause scattering of the light emitted from the light source 16. Thus, the incorporation of the intermediate light-transmitting medium 22 not only provides for the desired emission of light of a perceived color different than that of the light source 16, it also causes some scattering of light and thus assists in ensuring that the collective light pattern on the light-emitting surface 18 of the diffusing member 12 appears uniform.

Figure 3:
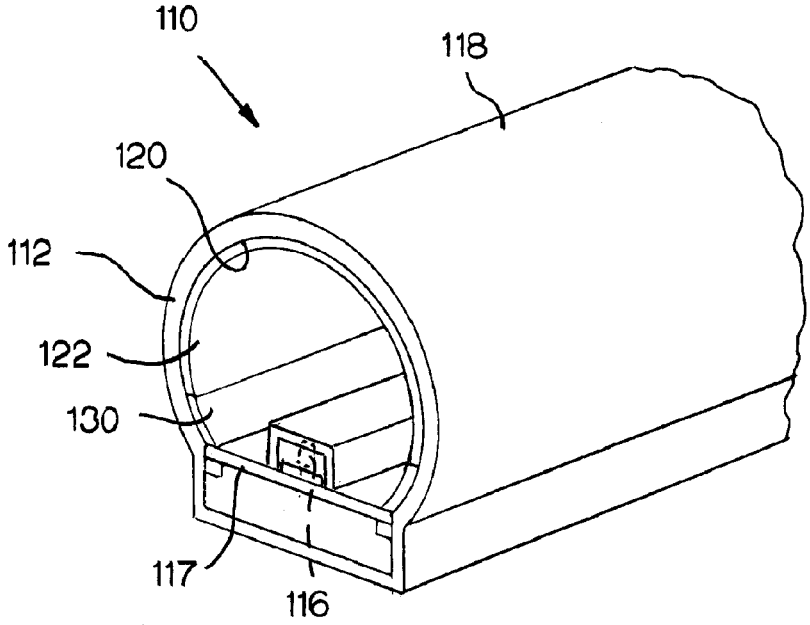
FIG. 3 is a perspective view of a portion of another exemplary illumination device made in accordance with the present invention.
Figure 4:
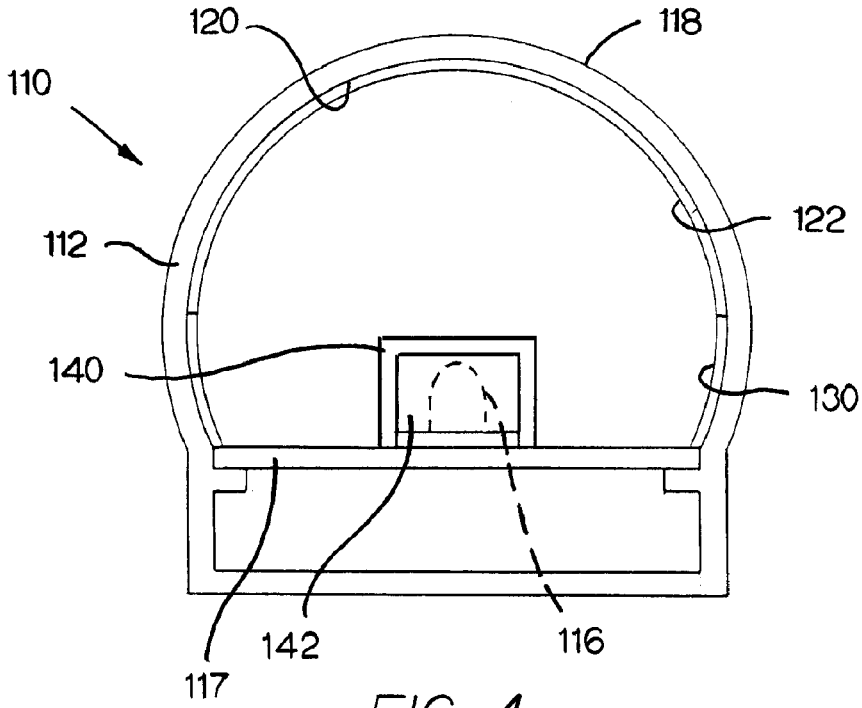
FIG. 4 is an end view of the illumination device of FIG. 3.

FIGS. 3 and 4 are views of another exemplary illumination device 110 made in accordance with the present invention. Similar to the exemplary embodiment described above with reference to FIGS. 1 and 2, the illumination device 10 is generally comprised of an elongated diffusing member 112 and a light source 116. Furthermore, the diffusing member 112 has a substantially hollow tube construction, with an external surface 118 serving as a light-emitting surface and an interior surface 120 that serves as a light-receiving surface. Light entering the diffusing member 112 from the light source 116 is scattered within the diffusing member 112 so as to exit with diffused distribution along the light-emitting surface 118.

As best shown in FIG. 4, the light source 116, preferably a string or strings of contiguously mounted high-intensity light-emitting diodes (LEDs), and associated electrical accessories (including a circuit board 117) are preferably enclosed within the diffusing member 112. In this regard, the circuit board 117 is preferably reflective.

The illumination device further includes a light color conversion system, specifically an intermediate light-transmitting medium 122 extending along and positioned between the light source 116 and the diffusing member 112. This intermediate light-transmitting medium 122 is preferably composed of a matrix of a substantially translucent acrylic or similar material tinted with a predetermined combination of one or more fluorescent dyes.

In this particular embodiment, and as shown in FIGS. 3 and 4, the light-transmitting medium 122 is a layer of such tinted material applied to a portion of the interior circumferential wall of the diffusing member 112. Furthermore, this exemplary illumination includes a reflective surface or coating 130, which is applied to a lower portion of the interior circumferential wall of the diffusing member 112 on either side of and near the light source 116. This reflective surface or coating 130 serves to collect and direct light upwardly toward the upper portion of the diffusing member 112 to increase efficiency and the perceived intensity of the emitted light.

As a further refinement, unlike the exemplary embodiment described above with reference to FIGS. 1 and 2, the light source 116 is substantially surrounded by a scattering member 140. This scattering member 140 causes some initial scattering of the light emitted from the light source 116 before it enters the intermediate light-transmitting medium 122, thus serving to further smooth the light and ensure a uniform and diffused distribution of light along the light-emitting surface 118. This scattering member 140 may be made of an acrylic material identical to that comprising the diffusing member 112. Alternatively, the scattering member 140 may be a holographic sheet, which is a form of diffraction grating with microscopic grooves that scatter the light.

Furthermore, in the exemplary embodiment illustrated in FIGS. 3 and 4, interposed between the light source 116 and the scattering member 140 is a second light-transmitting medium 142, which also is preferably composed of a matrix of a substantially translucent acrylic or similar material tinted with a predetermined combination of one or more fluorescent dyes. Accordingly, some color changing occurs near the light source 116 as light passes through the second light-transmitting medium 142, and the color is then further changed as light passes through the intermediate light-transmitting medium 122.

In addition to the embodiments described above with reference to FIGS. 1–4, as yet a further refinement, it is also contemplated that, to ensure that a substantially uniform light pattern is perceived along the light-emitting surface 18, 118 of the diffusing member 12, 112 of the illumination device 10, 110, a collector may be provided around the light source 16, 116 or around each individual point light source for directing light emitted from the light source 16, 116 into the diffusing member 12, 112. To accomplish this objective, it is further contemplated that the surfaces of such collectors be provided with a light-reflecting material, such as a mirror, white coating, paint, or tape.

It will be obvious to those skilled in the art that further modifications may be made to the embodiments described herein without departing from the spirit and scope of the present invention.

What is claimed is:

1. An illumination device, comprising:

a light source emitting light of a predetermined first hue;

an elongated diffusing member substantially enclosing said light source; and an intermediate light-transmitting medium tinted with a predetermined combination of one or more light-fluorescing dyes and extending along and positioned between said light source and said diffusing member, said intermediate light-transmitting medium including a light-receiving surface for receiving light emitted from said light source and a light-emitting surface for emitting light into said diffusing member, each of said light-fluorescing dyes emitting light of a predetermined wavelength following absorption of light from said light source, wherein a collective light ultimately emitted from said diffusing member is of a second hue with a substantially uniform intensity along the predetermined length of said diffusing member.

2. The illumination device as recited in claim 1, wherein the light-transmitting medium is applied to a portion of an interior circumferential wall of said diffusing member.

3. The illumination device as recited in claim 1, wherein the predetermined hue of said light source is blue.

4. The illumination device as recited in claim 1, wherein said second hue is substantially white.

5. The illumination device as recited in claim 3, wherein said second hue is substantially white.

6. The illumination device as recited in claim 1, wherein said light source is a plurality of light-emitting diodes.

7. The illumination device as recited in claim 1, wherein a reflective coating is applied to a lower portion of an interior circumferential wall of said diffusing member on either side of and near the light source, said reflective coating serving to collect and direct light upwardly toward the diffusing member.

8. The illumination device as recited in claim 1, wherein said light source is substantially surrounded by a scattering member, thus causing some initial scattering of the light emitted from said light source before it enters the intermediate light-transmitting medium.

9. The illumination device as recited in claim 8, wherein said scattering member is a holographic sheet.

10. The illumination device as recited in claim 8, wherein a second light-transmitting medium is interposed between the light source and the scattering member, said second light-transmitting medium also being tinted with a predetermined combination of one or more fluorescent dyes, thus causing some initial color changing near the light source.

11. An illumination device, comprising:

a light source;

an intermediate light-transmitting medium extending along and positioned adjacent said light source, said intermediate light-transmitting medium being tinted with a predetermined combination of one or more fluorescent dyes; and an elongated diffusing member substantially enclosing said light source and said intermediate light-transmitting medium, said diffusing member defining a light-receiving surface and a light-emitting surface, the light-receiving surface of said diffusing member being positioned adjacent said intermediate light-transmitting medium;

wherein light emitted from said light source and having a first perceived color is partially absorbed by the predetermined combination of fluorescent dyes of said intermediate light-transmitting medium, such that light transmitted through said intermediate light-transmitting medium to the light-receiving surface of said diffusing member has a second perceived color resulting from a collective light of multiple wavelengths; and wherein the optical and light scattering properties of said diffusing member result in a substantially uniform light intensity pattern on the light-emitting surface of said diffusing member.

12. The illumination device as recited in claim 11, wherein said light source is a plurality of light-emitting diodes.

13. The illumination device as recited in claim 11, wherein the first perceived color is blue.

14. The illumination device as recited in claim 11, wherein the second perceived color is white.

15. The illumination device as recited in claim 13, wherein the second perceived color is white.

16. The illumination device as recited in claim 11, wherein the second perceived color has color coordinates within the white region defined by the CIE Chromaticity diagram.

17. The illumination device as recited in claim 13, wherein the second perceived color has color coordinates within the white region defined by the CIE Chromaticity diagram.

18. The illumination device as recited in claim 11, wherein the light-transmitting medium is applied to a portion of an interior circumferential wall of said diffusing member.

19. The illumination device as recited in claim 11, wherein a reflective coating is applied to a lower portion of an interior circumferential wall of said diffusing member on either side of and near the light source, said reflective coating serving to collect and direct light upwardly toward the diffusing member.

20. The illumination device as recited in claim 11, wherein said light source is substantially surrounded by a scattering member, thus causing some initial scattering of the light emitted from said light source before it enters the intermediate light-transmitting medium.

21. The illumination device as recited in claim 20, wherein said scattering member is a holographic sheet.

22. The illumination device as recited in claim 20, wherein a second light-transmitting medium is interposed between the light source and the scattering member, said second light-transmitting medium also being tinted with a predetermined combination of one or more fluorescent dyes, thus causing some initial color changing near the light source.

23. An illumination device for simulating neon lighting, comprising:

an elongated diffusing member having a substantially hollow tube construction;

a plurality of light-emitting diodes enclosed within said diffusing member, said light-emitting diodes emitting light of a predetermined first hue; and an intermediate light-transmitting medium positioned within and extending along said diffusing member, said intermediate light-transmitting medium composed of a matrix of substantially translucent material tinted with one or more light-fluorescing dyes, wherein light emitted from said light-emitting diodes is partially absorbed by said light-fluorescing dyes and converted into a lower-energy light, such that there is a substantially uniform and elongated light pattern emitted from said diffusing member with a perceived hue that is different than said predetermined first hue.

24. The illumination device as recited in claim 23, in which the substantially translucent material tinted with one or more light-fluorescing dyes is applied to a portion of an interior circumferential wall of said diffusing member.

25. The illumination device as recited in claim 23, and further comprising a reflective coating applied to a lower portion of an interior circumferential wall of said diffusing member, said reflective coating serving to collect and direct light upwardly toward said diffusing member.

* * * * *